US009464760B2

(12) United States Patent
Tsai

(10) Patent No.: US 9,464,760 B2
(45) Date of Patent: Oct. 11, 2016

(54) GAS FILLING NOZZLE WITH SAFETY FUNCTION

(71) Applicant: Wei-Ming Tsai, New Taipei (TW)

(72) Inventor: Wei-Ming Tsai, New Taipei (TW)

( * ) Notice: Subject to any disclaimer, the term of this patent is extended or adjusted under 35 U.S.C. 154(b) by 295 days.

(21) Appl. No.: 14/317,191

(22) Filed: Jun. 27, 2014

(65) Prior Publication Data

US 2015/0292680 A1 Oct. 15, 2015

(30) Foreign Application Priority Data

Apr. 9, 2014 (TW) ..... 103113014 A

(51) Int. Cl.

| | |
|---|---|
| ***B65B 1/04*** | (2006.01) |
| ***F17C 7/00*** | (2006.01) |
| ***B65B 31/00*** | (2006.01) |
| *F17C 5/06* | (2006.01) |
| *B65D 83/42* | (2006.01) |

(52) U.S. Cl.

CPC ..... *F17C 7/00* (2013.01); *B65B 31/003* (2013.01); *B65D 83/425* (2013.01); *F17C 5/06* (2013.01)

(58) Field of Classification Search

CPC ..... B65B 31/003; F17C 5/02; F17C 5/06; B65D 83/425; B65D 83/14

USPC ..... 141/3, 20

See application file for complete search history.

(56) References Cited

U.S. PATENT DOCUMENTS 5,887,609 A * 3/1999 Garretson ..... F16K 21/165 137/2

* cited by examiner

*Primary Examiner* — Jason K Niesz

(74) *Attorney, Agent, or Firm* — Guice Patents PLLC

(57) ABSTRACT

A gas filling nozzle with safety function includes a valve seat, a first thimble, a safety valve, an inner sleeve and a first spring; the first thimble is sleeved in the valve seat, the safety valve is disposed at the top of the first thimble, and the inner sleeve is combined at the top of the valve seat, thereby allowing the first spring to be disposed between the inner sleeve and the safety valve. So when the gas filling nozzle is subject to a high temperature environment, the high-pressure gaseous/liquid mixture inside a gas container is able to be discharged to the exterior through the safety valve, thereby preventing the gas container from exploding.

8 Claims, 5 Drawing Sheets

GAS FILLING NOZZLE WITH SAFETY FUNCTION

BACKGROUND OF THE INVENTION

1. Field of the Invention

The present invention relates to a nozzle used in a gas container, especially to a gas filling nozzle with safety function, for example capable of preventing the gas container from exploding in a high temperature environment.

2. Description of Related Art

Fire is a must have element in our lives, with fire, we can cook food, can be provided with lighting, and the fire can also be used for combustion operations such as forging, soldering and welding. As such, the fuel, e.g. gas, is often formed in a gaseous status and the gas has to be stored in a high-pressure-sustainable metal container, for example a gas tank or a canned gas for ensuring the operation safety.

The top of a conventional gas tank is installed with a rotary control valve for allowing the gas to filled and stored or outputted, in other words the control valve is a bidirectional valve when being in an opened status; however, the volume of the gas tank is relatively large thereby not easy to be carried around.

The top of a conventional canned gas is also installed with a control valve which is set to be closed in a normal status, and the filling operation is to utilize high pressure to enable the liquid gas to pass the control valve and be filled in a can body, thereby allowing the canned gas to be provided with an advantage of easy to be carried around. However, the canned gas is not installed with a filling nozzle, when the liquid gas inside the canned gas ran out, the canned gas would be thrown away thereby causing unnecessary wastes. As such, the applicant of the present invention has developed a gas container, for example the Taiwan Patent Application NO. 103108440 has disclosed a gas container having a filling nozzle, so the gas container is capable of being repeatedly refilled and storing high-pressure liquid gas and allowing a user to easily hold and carry around.

A conventional combustion tool having a gas container is installed with a filling nozzle, so when the liquid gas inside the gas container ran out, additional liquid gas can be filled and stored in the gas container through the filling nozzle.

However, when the gas container is subject to a high temperature environment, e.g. being placed in an incinerator or in a vehicle exposed under sunlight, when the temperature inside the vehicle is getting higher, the vaporization of the liquid gas is facilitated, and the pressure inside the gas container would be rapidly increased, so the gas container is very likely to explode.

As such, the skilled people in the art would additionally install a safety valve at a proper location of the gas container, e.g. the top of the gas container, so when the pressure inside the gas container is greater than the preset pressure of the safety valve, the safety valve is able to be immediately opened for discharging the high-pressure gaseous/liquid mixture inside the gas container to the exterior, thereby preventing the gas container from exploding.

However, the safety valve has to be additionally installed on the gas container, so the assembly process would be complicated, and if the area of the gas container is overly small, the safety valve is unable to be installed thereon; as such, how to design a filling nozzle with safety function shall be seriously conserved by the skilled people in the art.

SUMMARY OF THE INVENTION

One primary objective of the present invention is to provide a gas filling nozzle with safety function, in which a safety valve is installed, so when a gas container installed with the gas filling nozzle is subject to a high temperature environment, the high-pressure gaseous/liquid mixture inside the gas container is able to be discharged to the exterior through the safety valve, thereby preventing the occurrence of explosion.

For achieving said objective, one technical solution provided by the present invention is to provide a gas filling nozzle with safety function, which includes: a valve seat, the interior thereof is axially formed with a stepped seat hole composed of a top seat hole and a bottom seat hole, and the exterior thereof is formed with a combination part; a first thimble, disposed in the seat hole, and the lower portion thereof is protruded out from the bottom seat hole, the interior of the first thimble is axially formed with a stepped thimble hole composed of a top thimble hole and a bottom thimble hole, a neck part defined at the outer periphery is radially formed with a neck hole communicated with the bottom thimble hole, and when the neck hole is not in a gas filling status, the neck hole is shielded by a sealing ring which is sleeved with the neck part; a safety valve, allowing a first spring and a second thimble to be disposed in the top thimble hole, and an end cover having the top being axially formed with a penetrate hole is combined with the top thimble hole, thereby allowing the second thimble to axially and elastically retract in the top thimble hole for sealing or opening the penetrated hole; and an inner sleeve, combined in the top seat hole, and the first spring is disposed between the end cover and a sleeve hole axially formed on the inner sleeve, thereby allowing the first thimble and the safety valve disposed at the top thereof to axially and elastically retract in the sleeve hole for enabling the sealing ring to seal or open the bottom seat hole, and the outer periphery of the inner sleeve is axially and annularly formed with a plurality of guide slots communicated with the top seat hole.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
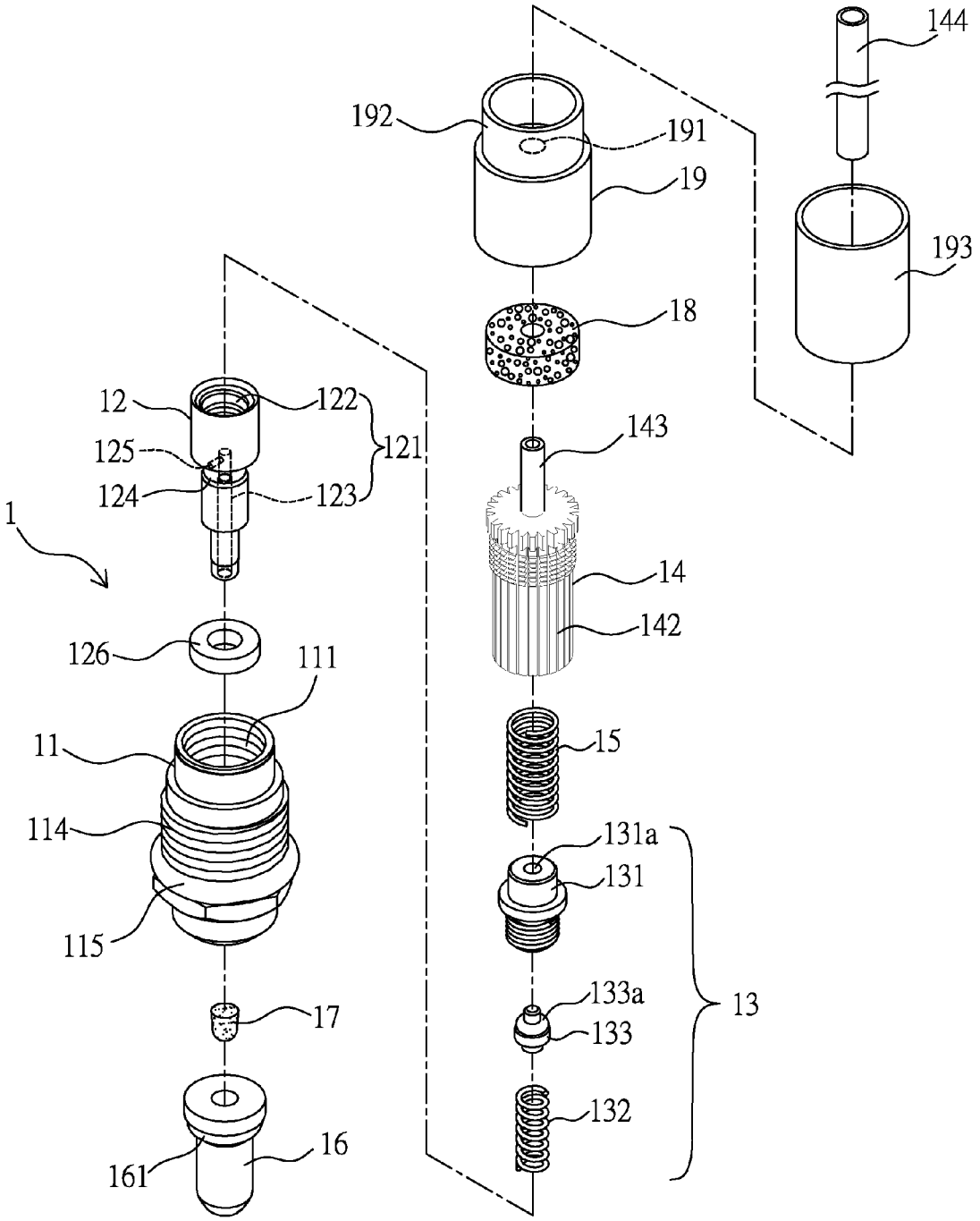
FIG. 1 is a perspective exploded view illustrating the gas filling nozzle according to the present invention.
Figure 2:
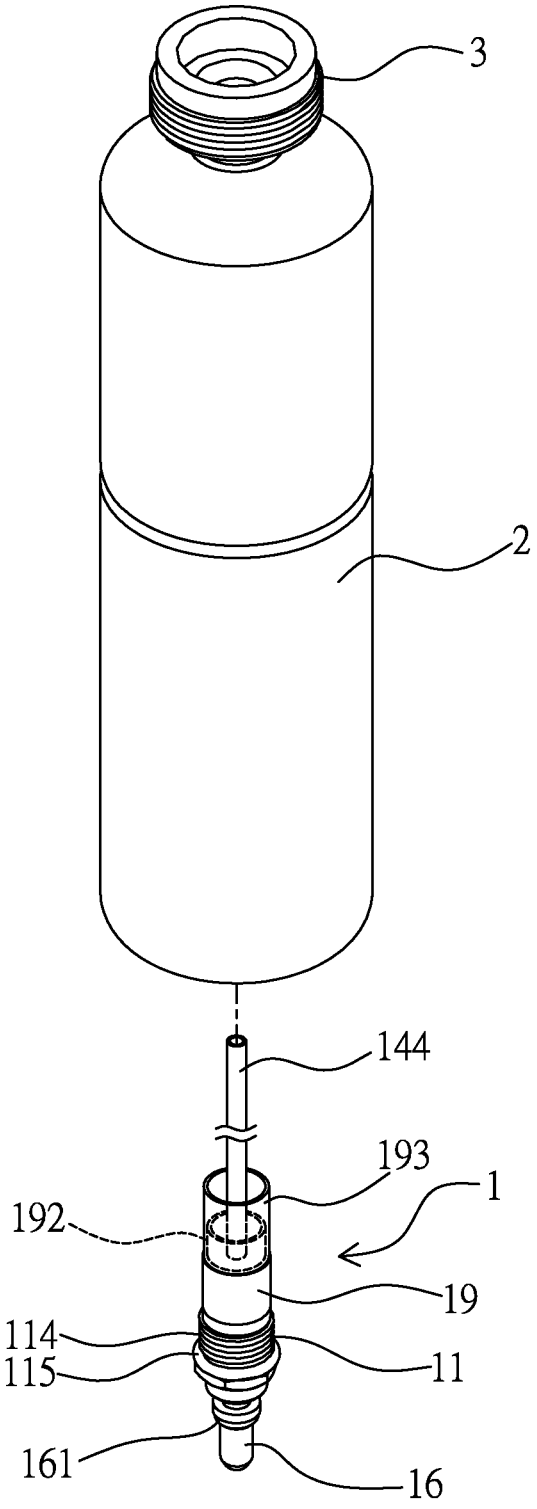
FIG. 2 is a perspective view illustrating the gas filling nozzle being installed with a gas container according to the present invention.
Figure 3:
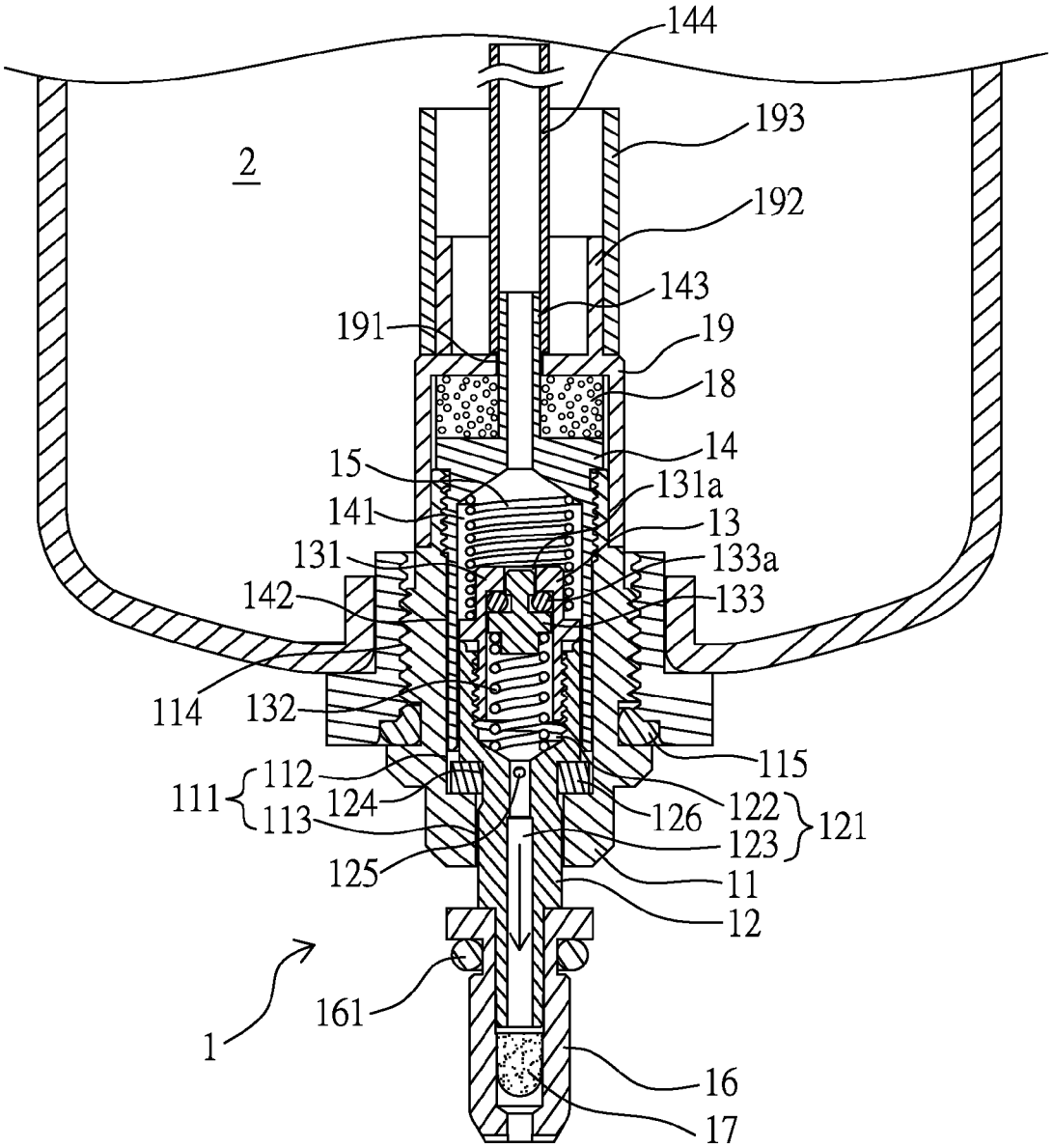
FIG. 3 is a cross sectional view illustrating the assembly of the gas filling nozzle and the gas container shown in FIG. 2.

Referring from FIG. 1 to FIG. 3, the present invention provides a gas filling nozzle 1, which includes a valve seat 11, a first thimble 12, a safety valve 13, an inner sleeve 14 and a first spring 15.

The interior of the valve seat 11 is axially formed with a stepped seat hole 111, and the seat hole 111 includes a top seat hole 112 formed at the upper portion and having a relatively larger inner diameter and a bottom seat hole 113 formed at the lower portion and having a relatively smaller inner diameter; the stepped first thimble 12 is disposed in the seat hole 111, thereby allowing the lower portion of the first thimble 12 to be protruded out of the bottom seat hole 113; the safety valve 13 is disposed at the top of the first thimble 12; the inner sleeve 14 is combined, e.g. screw-fitted, in the top seat hole 112; and the first spring 15 is disposed between the safety valve 13 and the top inner wall of a sleeve hole 141 formed on the inner sleeve 14, thereby allowing the first thimble 12 and the safety valve 13 disposed at the top thereof to axially and elastically retract in the sleeve hole 141 of the inner sleeve 14. Wherein, the outer periphery of the valve seat 11 is sleeved with a first anti-leaking ring 115, so after the valve seat 11 is connected to a gas container 2, an airtight effect is able to be provided through the first anti-leaking ring 115.

The outer periphery of the inner sleeve 14 is axially and annularly formed with a plurality of guide slots 142, thereby allowing the gas inside the gas container 2 to be discharged and allowing liquid gas to be filled in. In addition, the top surface of the inner sleeve 14 is axially extended with a discharge pipe 143 communicated with the sleeve hole 141, and the discharge pipe 143 is further connected to an extension pipe 144, thereby allowing the liquid gas to be filled in the gas container 2.

Moreover, the interior of the first thimble 12 is formed with a stepped thimble hole 121, and the thimble hole 121 includes a top thimble hole 122 formed at the upper portion and having a relatively larger inner diameter and a bottom thimble hole 123 formed at the middle and lower portion and having a relatively smaller inner diameter; a neck part 124 defined at the upper portion of the outer periphery is radially formed with a neck hole 125 communicated with the bottom thimble hole 123, and when the neck hole 125 is not in a gas filling status, the neck hole 125 is shielded by an elastic sealing ring 126 which is sleeved with the neck part 124, thereby preventing the liquid gas from passing the neck hole 125 so as to form a sealed status.

Furthermore, the bottom of the first thimble 12 is sleeved with a connection pipe 16, and the outer periphery of the connection pipe 16 is sleeved with a third anti-leaking ring 161, thereby forming an airtight effect during the gas filling status. Wherein, the interior of the connection pipe 16 is provided with a first filtering material 17 adjacent to the bottom of the first thimble 12 and used for filtering the impurities which are about to enter the gas filling nozzle 1. The discharge pipe 143 is disposed adjacent to a second filtering material 18 which is used for filtering the impurities discharged from the gas container 2. In addition, a top cover 19 is provided at the top of the valve seat 11 and used for covering the second filtering material 18 and the top of the inner sleeve 14, and the discharge pipe 143 is protruded out from a cover hole 191 formed at the top of the top cover 19. Wherein, in actual practice, the first and the second filtering material 17, 18 are preferably to be a sintered member with micro pores formed through powder metallurgy or a sponge cushion. In addition, the outer periphery of the cover hole 191 of the top cover 19 is further extended with an engage ring 192, and the engage ring 192 is sleeved with a position limiting pipe 193.

The safety valve 13 includes an end cover 131, a second spring 132 and a second thimble 133. The top of the stepped end cover 131 is axially formed with a penetrated hole 131*a* thereby allowing the end cover 131 to be combined, e.g. screw-fitted, with the top thimble hole 122; the second spring 132 is disposed in the top thimble hole 122; and the cross-shaped second thimble 133 is sleeved at the top end of the second spring 132, wherein the outer periphery of the second thimble 133 is sleeved with a second anti-leaking ring 133*a*, thereby allowing the upper portion of the second thimble 133 to penetrate into the penetrated hole 131*a*, and the second anti-leaking ring 133*a* is enabled to constantly seal the penetrated hole 131*a* so as to form an airtight status. The bottom end of the first spring 15 is sleeved with the end cover 131 and able to be moved through the axial movement of the first thimble 12 and the safety valve 13 for compressing the first spring 15.

As shown in FIG. 2, after the gas filling nozzle 1 is assembled as an individual member, a combination part 114, e.g. formed as a thread part, of the gas filling nozzle 1 is screw-fitted with a screw-fitting part preformed on the bottom surface of the gas container 2, and an airtight effect is able to be formed through the first anti-leaking ring 115, wherein the status of the gas filling nozzle 1 being fastened with the gas container 2 is shown in FIG. 3. The top of the gas container 2 is formed with a discharge part 3, and the discharge part 3 can be further connected to a conventional combustion tool, e.g. but not limited to a heating torch; the top of the gas container 2 is able to be directly installed with a combustion tool, thereby allowing the gas container 2 to be served as a handgrip.

Referring to FIG. 1 and FIG. 3, when the gas filling nozzle 1 is assembled as an individual member and installed at the bottom of the gas container 2, the first spring 15 is in a stretched status, and the sealing ring 126 of the first thimble 12 is enabled to constantly seal the bottom seat hole 113 so as to form an airtight status; at this moment, the liquid gas inside the gas container 2 is able to enter the top cover 19 through a gap formed between the discharge pipe 143 and the cover hole 191, and filtered by the second filtering material 18 and passed the guide slots 142 of the inner sleeve 14 for allowing the liquid gas to be filled in the top seat hole 112, but the liquid gas is stopped by the sealing ring 126 thereby not being able to pass the bottom seat hole 113 for being discharged out from the gas filling nozzle 1. In addition, the neck hole 125 is shielded by the sealing ring 126, so the liquid gas inside the gas container 2 is unable to pass the first thimble 12 and the connection pipe 16 for being discharged out from the gas filling nozzle 1.

Figure 4:
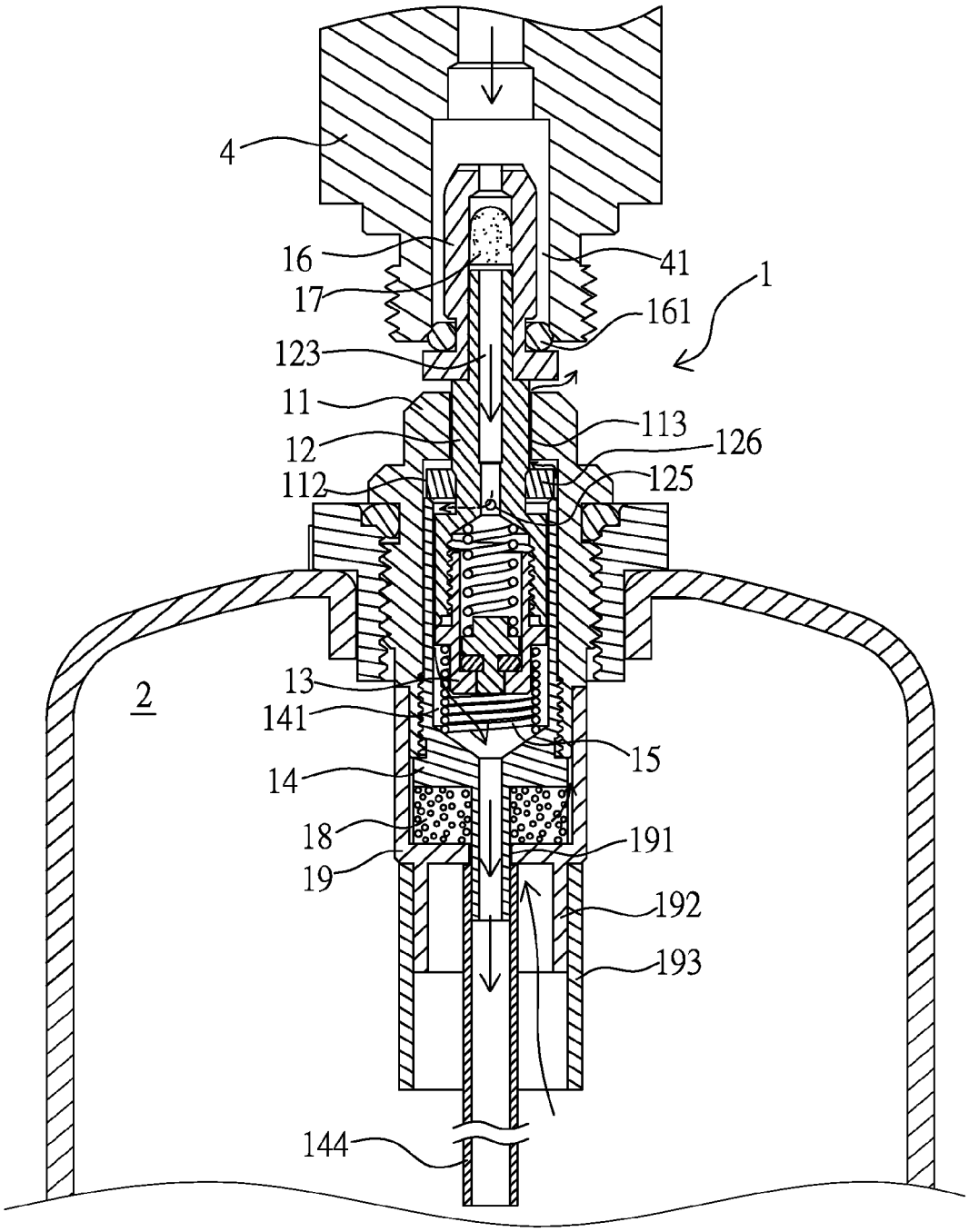
FIG. 4 is a cross sectional view illustrating the gas filling nozzle being in a liquid gas filling status according to the present invention.

Referring to FIG. 4, if a gas filling operation is desired to be processed, the gas container 2 is reversely placed, and a discharge nozzle 4 of a conventional canned gas is connected to the connection pipe 16 of the gas filling nozzle 1 for forming an inserted status, and the third anti-leaking ring 161 is able to be adjacent to an end of an opening 41 formed on the discharge nozzle 4 thereby forming an airtight effect, and the connection pipe 16 is abutted against the valve seat 11, thereby allowing the connection pipe 16 and the first thimble 12 to be downwardly moved along the inner sleeve 14 so as to compress the first spring 15, and the sealing ring 126 is downwardly moved with the first thimble 12 and abutted against the inner sleeve 14, so the bottom seat hole 113 is opened, and the neck hole 125 is exposed because the downward movement of the connection pipe 16 and the first thimble 12 is greater than the downward movement of the sealing ring 126; at this moment, the gas inside the gas container 2 is enabled to enter the top cover 19 through the gap formed between the discharge pipe 143 and the cover hole 191 and pass the second filtering material 18 and the guide slots 142 of the inner sleeve 14, so the gas filled in the top seat hole 112 is able to be discharged to the exterior because the sealing ring 126 allows the bottom seat hole 113 to be opened. The liquid gas inside the canned gas is only allowed to enter from the connection pipe 16 and filtered by the first filtering material 17, and the filtered liquid gas passes the bottom thimble hole 123 and the neck hole 125 of the first thimble 12 and enters the sleeve hole 141 of the inner sleeve 14 thereby being able to be filled in through the discharge pipe 143 and the extension pipe 144 and stored in the gas container 2.

When the liquid gas stored in the reversely-placed gas container 2 is in contact with the position limiting pipe 193, the excessive liquid gas is able to enter the top cover 19 through the above-mentioned gas discharging path, i.e. the gap formed between the discharge pipe 143 and the cover hole 191, and pass the second filtering material 18, the guide slots 142 of the inner sleeve 14 and the top seat hole 112 so as to be discharged from the bottom seat hole 113, the above-mentioned gas discharging status indicates a saturated status being formed, so the gas filling operation is able to be immediately stopped.

As a matter of fact, the longer the extension pipe 144, the shorter the position limiting pipe 193, and more liquid gas can be filled in the gas container 2; the shorter the extension pipe 144, the longer the position limiting pipe 193, and less liquid gas can be filled in the gas container 2.

Figure 5:
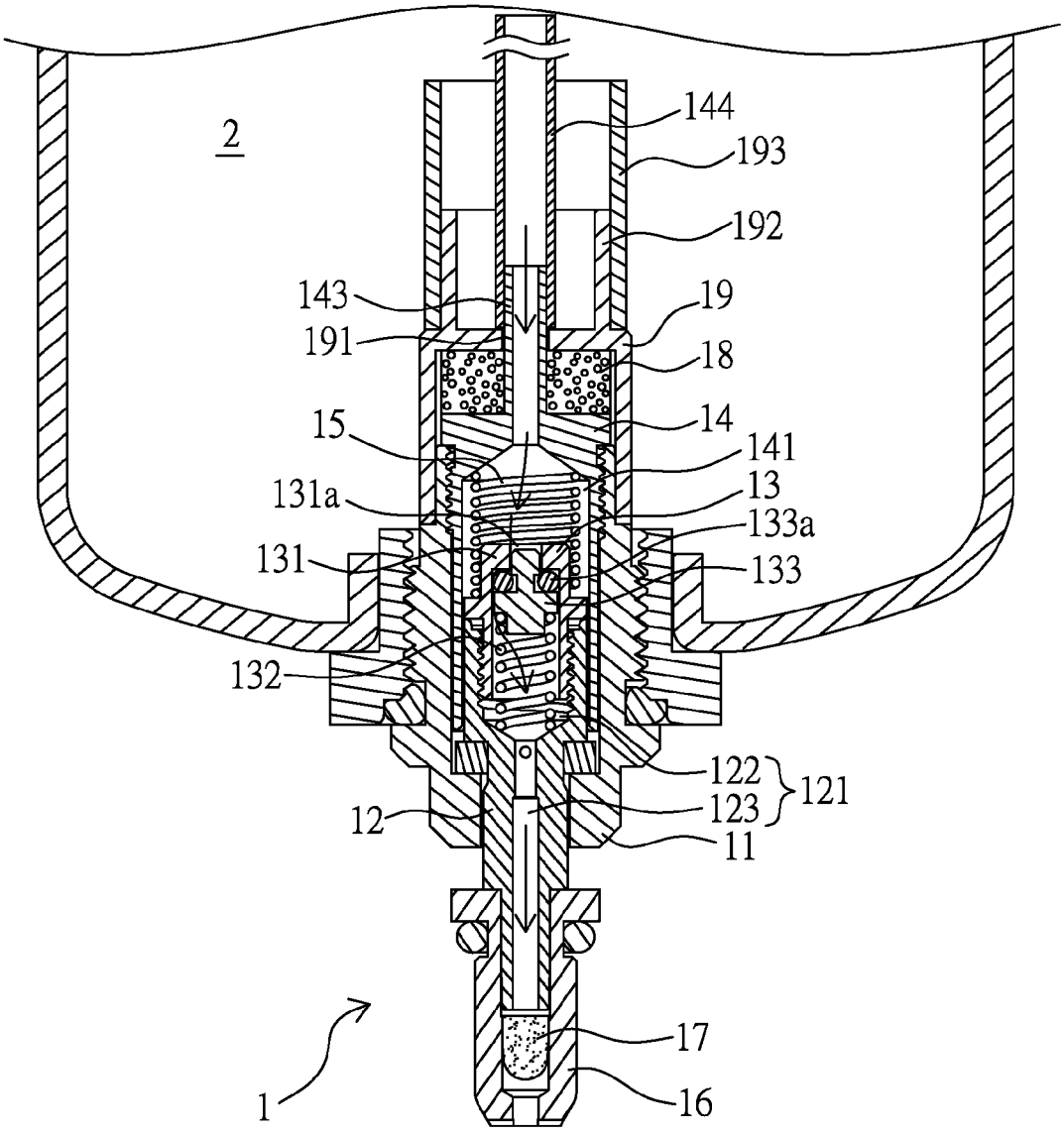
FIG. 5 is a cross sectional view illustrating the safety valve of the gas filling nozzle processing a pressure releasing operation according to the present invention.

Referring to FIG. 5, when the gas container 2 is subject to a high temperature environment, e.g. being placed in a vehicle exposed under sunlight, when the temperature inside the vehicle is getting higher, the vaporization of the liquid gas is facilitated, so the pressure inside the gas container 2 is rapidly increased; when the pressure inside the gas container 2 is greater than the preset elastic force (pressure) of the second spring 132, the second thimble 133 and the second anti-leaking ring 133*a* thereof are pressed for being downwardly moved, and the penetrated hole 131*a* of the end cover 131 is synchronously opened and the second spring 132 is compressed, so the high-pressure gaseous/liquid mixture inside the gas container 2 is enabled to pass the discharge pipe 143, the sleeve hole 141, the penetrated hole 131*a* of the end cover 131, the thimble hole 121 and the first filtering material 17 so as to be discharged to the exterior through the connection pipe 16, thereby preventing the occurrence of explosion.

Based on what has been disclosed above, advantages achieved by the present invention are: the first thimble of the gas filling nozzle is further installed with the safety valve, so when the gas container installed with the gas filling nozzle is subject to a high temperature environment, e.g. being placed in a vehicle exposed under sunlight, when the pressure inside the gas container is greater than the preset pressure of the safety valve, the safety valve is able to be immediately opened for discharging the high-pressure gaseous/liquid mixture inside the gas container to the exterior, thereby preventing the occurrence of explosion. Accordingly, gas filling nozzle with safety function provided by the present invention is novel and more practical in use comparing to prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A gas filling nozzle with safety function, including:

a valve seat, the interior thereof being axially formed with a stepped seat hole composed of a top seat hole and a bottom seat hole, and the exterior thereof being formed with a combination part;

a first thimble, disposed in said seat hole, and the lower portion thereof being protruded out from said bottom seat hole, the interior of said first thimble being axially formed with a stepped thimble hole composed of a top thimble hole and a bottom thimble hole, a neck part defined at the outer periphery being radially formed with a neck hole communicated with said bottom thimble hole, and when said neck hole not being in a gas filling status, said neck hole being shielded by a sealing ring which being sleeved with said neck part;

a safety valve, allowing a second spring and a second thimble to be disposed in said top thimble hole, and an end cover having the top being axially formed with a penetrate hole being combined with said top thimble hole, thereby allowing the second thimble to axially and elastically retract in said top thimble hole for sealing or opening said penetrated hole; and an inner sleeve, combined in said top seat hole, and a first spring being disposed between said end cover and a sleeve hole axially formed on said inner sleeve, thereby allowing said first thimble and said safety valve disposed at the top thereof to axially and elastically retract in said sleeve hole for enabling said sealing ring to seal or open said bottom seat hole, and the outer periphery of said inner sleeve being axially and annularly formed with a plurality of guide slots communicated with said top seat hole.

2. The gas filling nozzle with safety function as claimed in claim 1, wherein said combination part of said valve seat is formed as a thread part, and the outer periphery thereof is sleeved with a first anti-leaking ring.

3. The gas filling nozzle with safety function as claimed in claim 1, wherein the outer periphery of said second thimble is sleeved with a second anti-leaking ring.

4. The gas filling nozzle with safety function as claimed in claim 1, further including a connection pipe, the outer periphery thereof is sleeved with a third anti-leaking ring, and the interior thereof is provided with a first filtering material adjacent to the bottom of said first thimble and used for filtering impurities.

5. The gas filling nozzle with safety function as claimed in claim 1, wherein the top surface of said inner sleeve is axially extended with a discharge pipe communicated with said sleeve hole; said discharge pipe is disposed adjacent to a second filtering material used for filtering impurities, and a top cover is provided at the top of said valve seat for covering said second filtering material and the top of said inner sleeve, and said discharge pipe is protruded out from a cover hole formed at the top of said top cover.

6. The gas filling nozzle with safety function as claimed in claim 5, wherein said discharge pipe is further sleeved with an extension pipe; the outer periphery of said cover hole of said top cover is axially extended with an engage ring, and said engage ring is sleeved with a position limiting pipe.

7. The gas filling nozzle with safety function as claimed in claim 4, wherein said first and said second filtering material are a sintered member with micro pores formed through powder metallurgy or a sponge cushion.

8. The gas filling nozzle with safety function as claimed in claim 5, wherein said first and said second filtering material are a sintered member with micro pores formed through powder metallurgy or a sponge cushion.

* * * * *